United States Patent [19]

Lemke

[11] Patent Number: 4,601,527

[45] Date of Patent: Jul. 22, 1986

[54] SHIELDED HEADER AND CABLE ASSEMBLY

[75] Inventor: Timothy A. Lemke, Carlisle, Pa.

[73] Assignee: E. I. Du Pont de Nemours and Company, Wilmington, Del.

[21] Appl. No.: 692,957

[22] Filed: Jan. 18, 1985

[51] Int. Cl.[4] ..... H01R 4/66

[52] U.S. Cl. ..... 339/14 R; 339/143 R; 339/276 SF; 339/17 C

[58] Field of Search ..... 339/143, 14, 176 MP, 339/147 R, 147 P, 276 SF, 17 C

[56] References Cited

U.S. PATENT DOCUMENTS

| | | | |
|---|---|---|---|
| 2,169,962 | 8/1939 | Del Camp | 339/143 R |
| 4,195,893 | 4/1980 | Stupay | 339/14 R |
| 4,265,506 | 5/1981 | Hollyday | 339/147 R |
| 4,296,390 | 10/1981 | Vanderheyden et al. | 339/147 R |
| 4,371,226 | 2/1983 | Brancaleone | 339/143 R |
| 4,415,216 | 11/1983 | Narozny | 339/14 R |
| 4,464,003 | 8/1984 | Goodman et al. | 339/14 R |

*Primary Examiner*—Gil Weidenfeld
*Assistant Examiner*—David L. Pirlot

[57] ABSTRACT

Shielded header having a dielectric housing with electrical pins mounted therein. The header is ground to a cable connector, a computer chassis and a printed circuit board using a ground strip attached to the housing lower surface and a spring contact mounted to engage the cable connector inside the housing and the computer chassis and printed circuit board outside the housing.

11 Claims, 9 Drawing Figures

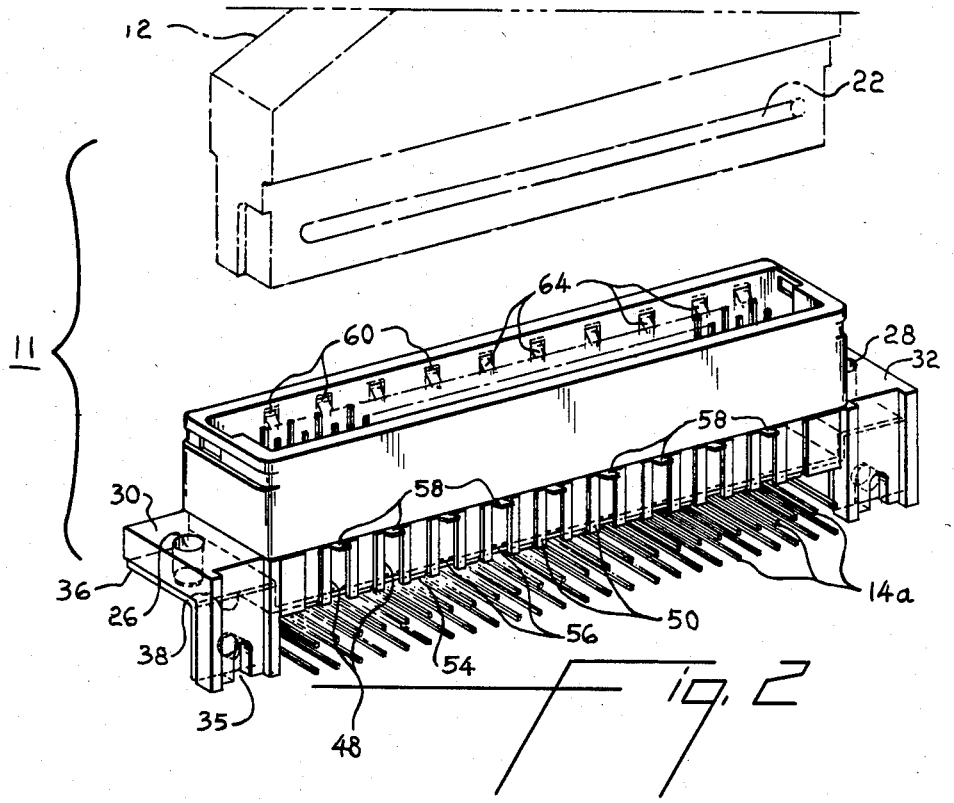
Fig. 2
Fig. 3
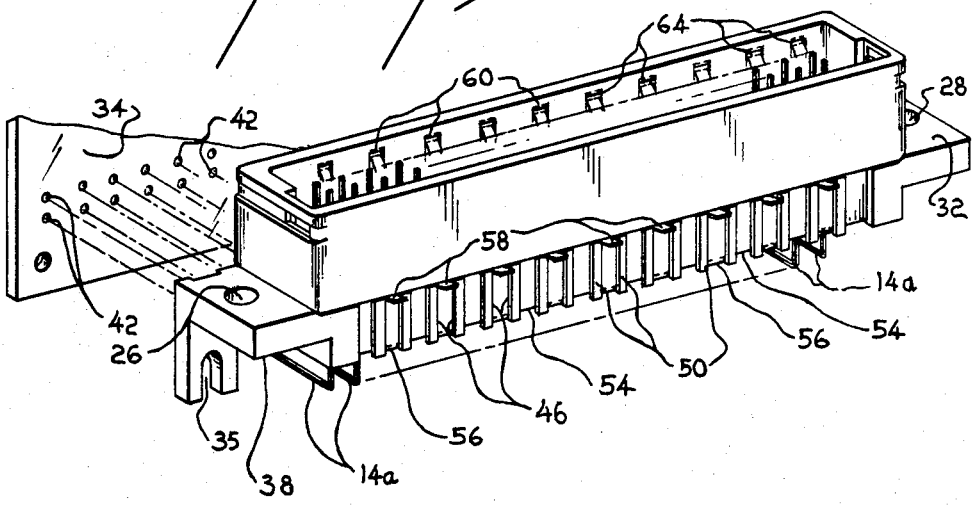

Fig. 4
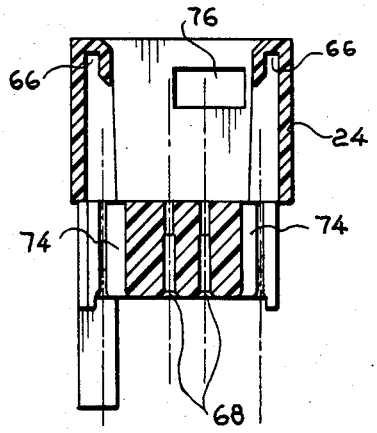
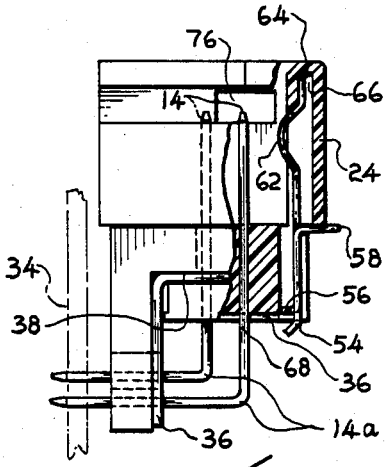
Fig. 6
Fig. 5
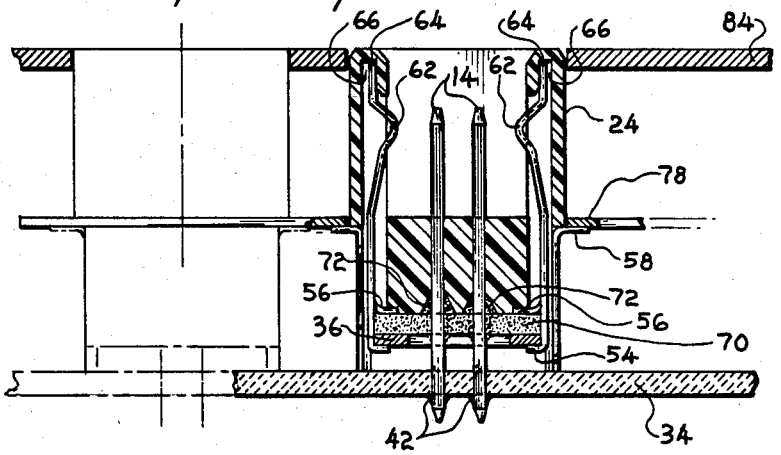

SHIELDED HEADER AND CABLE ASSEMBLY

DESCRIPTION

A. Technical Field

This invention relates to electrical connectors. More particularly, it refers to a shielded header used to electrically engage a cable connector to a printed circuit board or other electrical device.

B. Background Art

Shielded headers are commonly used to control high frequency electromagnetic signals discharged from computers and to prevent their interference with other electrical devices.

U.S. Pat. No. 4,386,814 describes a kit for converting a connector receiving aperture in a panel to a shielded pin receptacle. While this kit appears to provide the required shielding, it involves significant amounts of hand labor to make the conversion. Moreover, the pin receptacle is not designed to have any pre-loaded beams. Accordingly, it is expected that insertion forces would be high. A shielded header manufactured to contain all the necessary components for achieving electromagnetic shielding would eliminate the need for this hand labor and a design incorporating pre-loaded beams would reduce the insertion forces.

SUMMARY OF THE INVENTION

I have invented a shielded preassembled header that provides excellent protection against the escape of electromagnetic energy. It provides a low insertion force, low contact wear, adaptability to any length header and with metal parts suitable for high speed stamping. My shielded header comprises a dielectric housing having an inner cavity containing vertical through holes for receiving standard electrically conductive pins. Usually these pins are set forth in a double row. The exterior of the housing has rear grooves and front grooves for receiving a pair of metal spring contacts which are slid in the grooves between rib structures on the exterior of the housing and into a series of holes leading to the interior of the housing. The end of each beam on the metal spring contact is exposed within the interior of the housing so that ground contact can be made with a female cable connector engaged to the pins within the housing. A series of ground bars on the metal spring contact protrude to the exterior of the housing for chassis grounding. A ground strip attached at the bottom exterior of the housing provides additional ground to a circuit board. Optionally, a filter can be contained within the housing around the electrically conductive pins.

BRIEF DESCRIPTION OF THE DRAWINGS

The present invention may be best understood by those having ordinary skill in the art by reference to the following detailed description when considered in conjunction with the accompanying drawings in which:

FIG. 2 shows a front perspective view of a right-angled shielded header;

FIG. 3 shows a rear perspective view of a right-angled shielded header;

FIG. 4 shows a cross-section of an end view of the shielded header of FIG. 1 with no pins in the vertical through holes;

FIG. 5 shows a cross-section of an end view of the shielded header of FIG. 1 with the pins, spring contact and filter element in place;

FIG. 6 shows a partial cut-away cross-section of the shielded header of FIG. 3;

DETAILED DESCRIPTION OF THE PREFERRED EMBODIMENT

Figure 1:
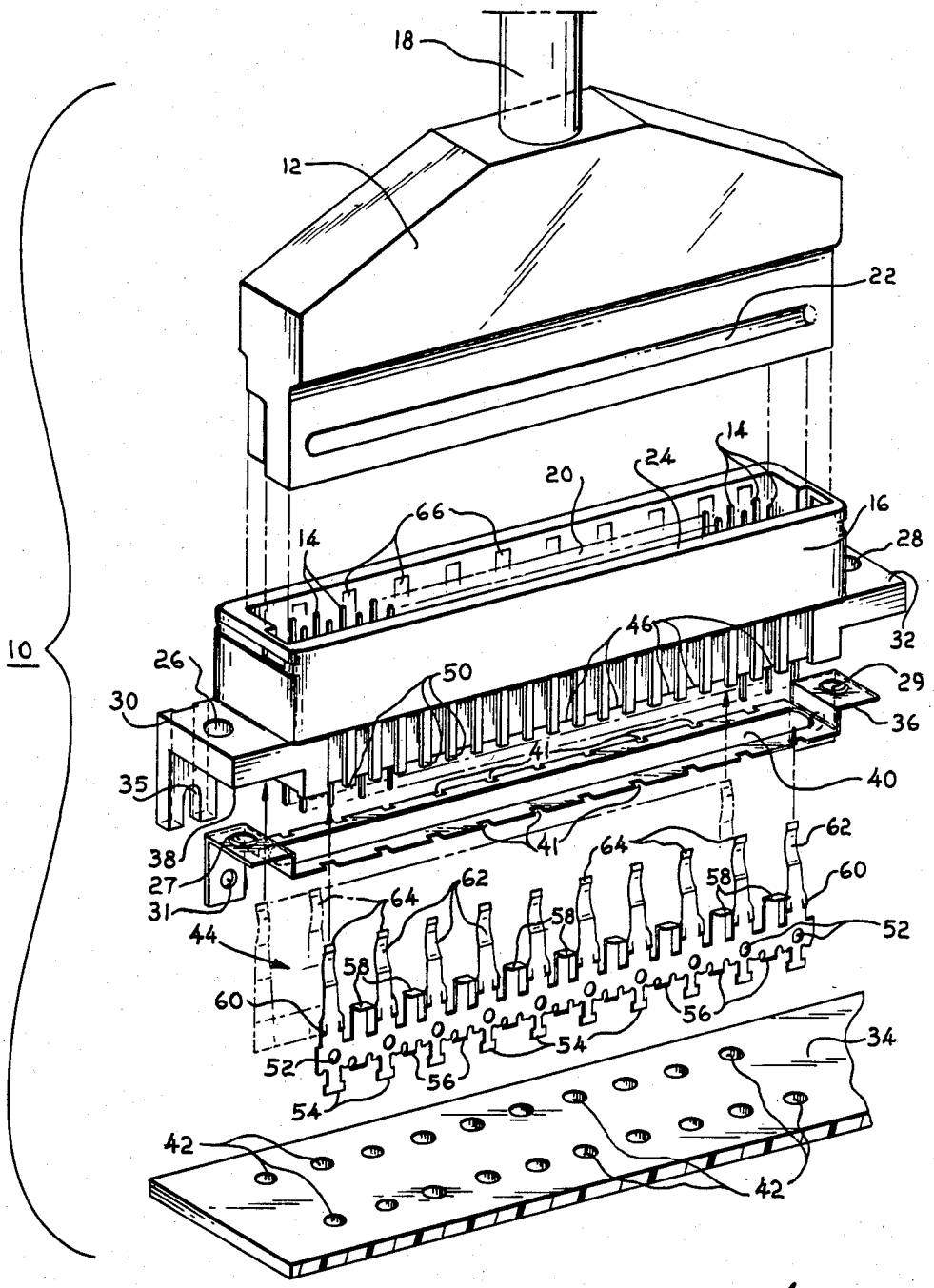
FIG. 1 shows an exploded perspective view of the shielded header assembly.

The shielded header assembly 10 comprises a female cable connector 12 containing female terminals (not shown) of sufficient number to engage pins 14 mounted within through holes 68 in a dielectric housing 16. One end of connector 12 is attached to an electrical cable 18 and the other end fits within cavity 20 between front and rear elongated side walls 24 of housing 16. A contact receptacle 22 on the exterior of connector 12 is in electrical contact with contact beams 62 on one of the two interior surfaces of side walls 24 forming cavity 20.

The housing 16 contains through holes 26 and 28 on L-shaped end portions 30 and 32 respectively for use in bolting the header housing 16 to a computer chassis 78 or other electrical device. A ground strip 36 is affixed to the bottom 38 of the housing 16. The ground strip 36 has an open mid-portion 40 to accommodate pins 14 passing through to enter holes 42 in the circuit board 34. Notches 41 on both edges of the ground strip 36 accommodate beams 62 on a spring contact 44. Holes 27 and 29 align with holes 26 and 28 respectively on housing 16. Holes 31 align with U-shaped opening 35 on housing 16 for use in attaching the header assembly to another device such as a circuit board 34.

An elongated conductive metal spring contact 44 is inserted into both the rear grooves 46 and front grooves 48 in the downward extension or side skirt of each side wall 24 housing 16. Vertical ribs 50 on the side skirts of both the rear and front side walls 24 of housing 16 delineate the grooves 46 and 48.

Figure 8:
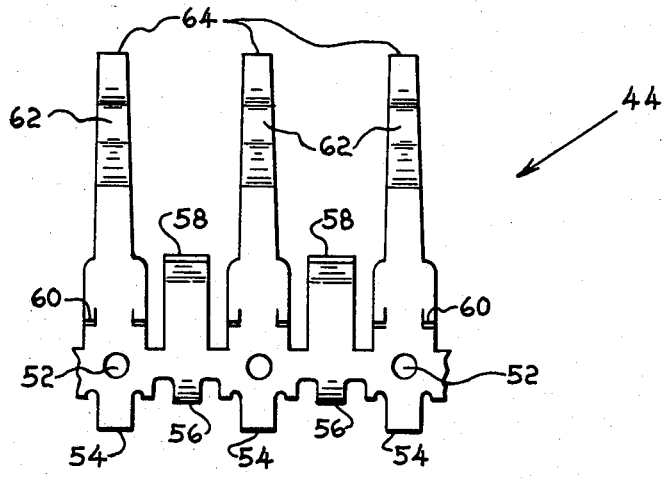
FIG. 8 shows an enlarged spring contact in elevation.

The elongated conductive metal spring contact 44 is stamped out of sheet stock in a high speed progressive dye and is thereafter formed as shown in FIGS. 1 and 8. Indexing holes 52, locking tabs 54, shelf tabs 56, ground bars 58, retention barbs 60 and contact beams 62 are all formed by state of the art procedures. Each beam 62 has one end 64 inserted into opening 66 in the interior surface of side wall 24 of housing 16. The spring contact 44 passes into hole 74 in housing 16 so that a portion of spring contact 44 is inside the housing 16 and a portion remains outside of housing 16 in grooves 46 and 48.

Figure 9:
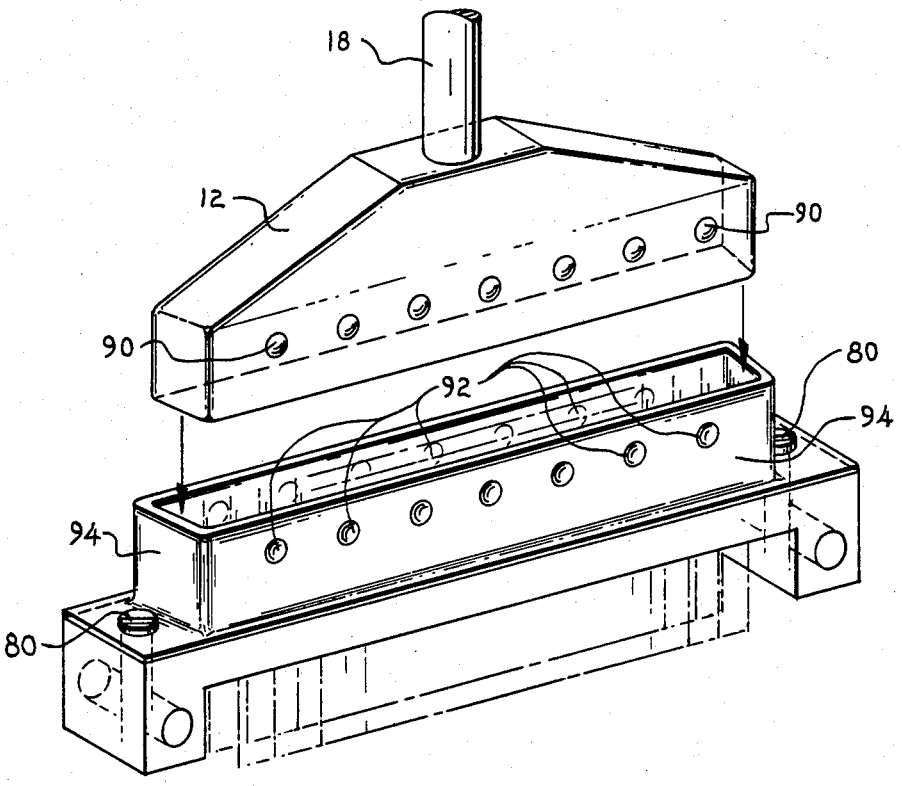
FIG. 9 shows a perspective of a prior art shielded header and cable assembly.

As stamped out, the locking tabs 54, retention barbs 60 and beams 62 are substantially in a common plane, whereas the ground bar 58 is at right angles to that plane and the shelf tabs 56 are curved at approximately a 45° angle from that plane but in the opposite direction from the ground bar 58. The metal spring contact 44 is inserted into the housing 16 by sliding beams 62 into grooves 46 or 48 and between ribs 50. The beams 62 pass through opening 74 in housing 16 so that the end of the beam 64 projects into slot 66 in the interior surface of side wall 24 of housing 16. Beam 62 is stressed or pre-loaded so as to reduce insertion force on the cable connector. Ground bars 58 come to rest at the L-shaped indentation in the housing 16 just above the end of the rear grooves 46 or front grooves 48. The ground bars make compliant contact to chassis 78 and ensure grounding along the entire side of the header instead of primarily at the ends as obtained by prior art headers shown in FIG. 9.

FIG. 2 shows a right-angles header assembly 11 whereby the ends of pins 14*a* are at right angles as opposed to the pins 14 in FIG. 1 which are straight. This view as well as the one shown in FIG. 3 shows the spring contact 44 inserted into the housing so that ground bars 58 are in final position. Two holes, 26 and 28, in the L-shaped ends 30 and 32, respectively, of housing 16 accommodate bolts 80. Groove 35 can be used for inserting a bolt from the header 16 directly to circuit board 34.

A latch receptacle 76 in the side of the housing 16 is an optional feature.

As shown in FIG. 5, the lock tab 54 is folded over the lower side of the ground strip 36 to lock it into position. The shelf tab 56 provides compliant contact with the other side of the ground strip 36. The ground bars 58 projects in a right angle from the housing 16 just below side wall 24. A chassis ground 78 is contacted to the ground bars 58.

FIG. 5 also shows an optional variation containing a filter 70 to provide additional protection against the escape of electromagnetic energy. The pins 14 are soldered 72 to the filter 70.

The tabs 60 in the spring clip 44 are used to anchor the spring strip into the plastic inner wall of housing 16.

Figure 7:
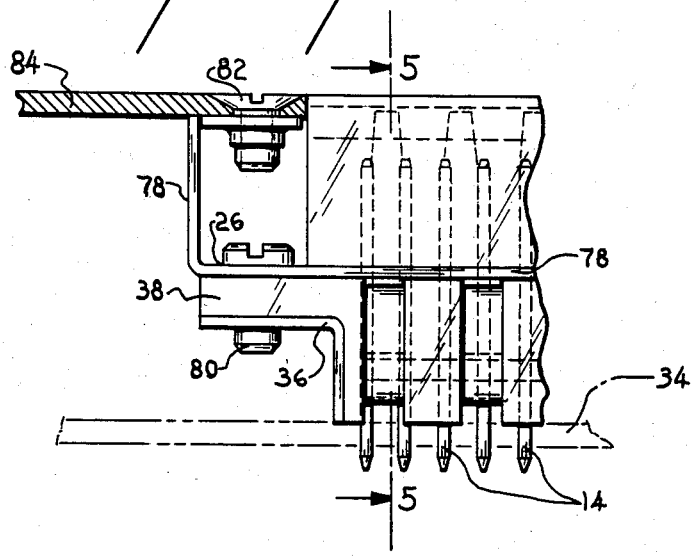
FIG. 7 shows a cut-away of an alternate design of the shielded header shown in FIG. 1.

Optionally another frame 84 can be mounted by bolt 82 as shown in FIG. 7 to the chassis frame 78.

The plastic housing can be made out of any dielectric material such as polycarbonate or polyester. The pins are usually phosphor bronze or other conductive metal as in the spring contact. The ground strip 36 can be made out of any conductive material such as steel, copper, aluminum, etc.

Having thus described the invention, what I claim and desire to be secured by Letters Patent is:

1. A shielded header for controlling high frequency electromagnetic signals comprising a. a dielectric housing having a cavity open at its top, enclosed by front and rear elongated side walls and two end walls together with a floor perforated with a plurality of through holes each engaging an electrically conductive pin, a side skirt extending downward from each front and rear side wall, with a plurality of vertical grooves, each groove separated by a vertical rib in each side skirt;

b. an elongated ground strip mounted between the side skirts, the ground strip having a plurality of notches aligned with a lower end of each vertical groove in the side skirt;

c. an electrically conductive spring contact stamped from metal stock and formed to have alternating beams projecting upward in a common plane from a carrier strip with L-shaped ground bars between each beam, one leg of the ground bar attached to the carrier strip in a plane substantially the same as the beams and the other leg projecting at a right angle to the plane, a plurality of locking tabs attached to the carrier strip and projecting downward away from each beam, a plurality of shelf tabs attached to the carrier strip and projecting downward away from each ground bar and curled in a direction away from the ground bars;

d. the spring contact mounted in the housing so that each beam is in contact with an interior side of the front and rear side wall, one leg of each ground bar projecting at right angles from the exterior of the side walls and the shelf tabs and locking tabs bent to grip opposite flat sides of the ground strip.

2. A shielded header assembly comprising a female shielded cable connector engaged to one end of the pins mounted in the shielded header of claim 1 and a printed circuit board mounted to the other end of the pins.

3. The shielded header according to claim 1 having L-shaped ears attached to the side walls of the housing with through holes therein for mounting the header to the chassis of a computer or a printed circuit board.

4. The shielded header according to claim 1 wherein the ground bars are in electrical contact with the chassis of an electrical device.

5. A shielded header according to claim 1 wherein each conductive pin is encircled by a filter element.

6. A shielded header for controlling high frequency electromagnetic signals comprising a dielectric housing having a cavity open at its top, enclosed by front and rear elongated side walls together with a floor having a plurality of through holes which engage electrical contacts, a side skirt extending downward from each front and rear side wall, an electrically conductive spring contact having a plurality of contact beams projecting upward in a common plane from a carrier strip, the spring contact mounted in the housing so that each beam is in contact with an interior side of the front and rear side wall, said contact beams alternating with L-shaped ground bars between each beam, one leg of each ground bar attached to the carrier strip in a plane substantially the same as the beams and the other leg projecting perpendicular to said plane.

7. A shielded header according to claim 6 further comprising an elongated ground strip mounted between the side skirts, and a plurality of locking tabs attached to the carrier strip and projecting downward away from each contact beam, said locking tabs bent to grip a flat side of the ground strip.

8. A shielded header according to claim 6 further comprising an elongated ground strip mounted between the side skirts, and a plurality of shelf tabs attached to the carrier strip and projecting downward away from each ground bar and curled in a direction away from the ground bars, each said shelf tab being bent to grip a flat side of the ground strip.

9. A shielded header according to claim 6, further comprising an elongated ground strip mounted between the side skirts, a plurality of locking tabs attached to the carrier strip and projecting downward away from each beam, a plurality of shelf tabs attached to the carrier strip and projecting downward away from each ground bar and curled in a direction away from the ground bars, the shelf tabs and locking tabs being bent to grip opposite flat sides of the ground strip.

10. A shielded header according to claim 6 wherein each electrical contact is encircled by a filter element.

11. A shielded header according to claim 6 wherein the ground bars are in electrical contact with a chassis of an electrical device.

* * * * *